US012797940B2

(12) United States Patent
Busch et al.

(10) Patent No.: US 12,797,940 B2
(45) Date of Patent: Nov. 17, 2026

(54) WORKPIECE MANIPULATOR

(71) Applicant: SMS group GmbH, Düsseldorf (DE)

(72) Inventors: Karsten Busch, Mönchengladbach (DE); Stefan Lauth, Mönchengladbach (DE)

(73) Assignee: SMS group GmbH, Düsseldorf (DE)

( * ) Notice: Subject to any disclaimer, the term of this patent is extended or adjusted under 35 U.S.C. 154(b) by 489 days.

(21) Appl. No.: 18/230,940

(22) Filed: Aug. 7, 2023

(65) Prior Publication Data

US 2024/0042511 A1 Feb. 8, 2024

(30) Foreign Application Priority Data

Aug. 8, 2022 (DE) ..... 102022208238.9

(51) Int. Cl.
*B21J 13/10* (2006.01)

(52) U.S. Cl.
CPC ..... *B21J 13/10* (2013.01)

(58) Field of Classification Search
CPC ..... B21J 13/10; B21J 7/14; B21J 7/18
See application file for complete search history.

(56) References Cited

U.S. PATENT DOCUMENTS

| | | | | | |
|---|---|---|---|---|---|
| 2,720,800 | A * | 10/1955 | Taylor | B21J 13/10 | 72/420 |
| 2,758,734 | A * | 8/1956 | Westling | B21J 13/10 | 414/586 |
| 3,476,276 | A * | 11/1969 | Bathory | B21J 13/10 | 414/620 |
| 3,631,996 | A * | 1/1972 | Bonesteel | B21J 13/10 | 414/739 |
| 3,712,096 | A | 1/1973 | Braunwieser et al. | | |
| 4,796,458 | A | 1/1989 | Schubert | | |
| 4,815,311 | A * | 3/1989 | Schubert | B21J 13/10 | 72/422 |
| 4,961,336 | A * | 10/1990 | Wilson | B21J 13/10 | 414/738 |
| 2010/0269562 | A1 | 10/2010 | Claasen | | |
| 2021/0284204 | A1 * | 9/2021 | Ebert | B61F 15/18 | |

FOREIGN PATENT DOCUMENTS

| | | | |
|---|---|---|---|
| CN | 111167989 | A | 5/2020 |
| CN | 217044456 | U | 7/2022 |
| DE | 2112743 | A1 | 9/1972 |
| DE | 2030473 | C3 | 12/1973 |
| DE | 3126120 | A1 | 1/1983 |
| DE | 3726763 | C2 | 11/1995 |
| DE | 102012217650 | A1 | 3/2014 |
| DE | 102014226384 | A1 | 6/2016 |
| EP | 2243572 | B1 | 6/2016 |
| JP | H05285584 | | 11/1993 |
| JP | S63180337 | B | 2/1995 |
| WO | 8806498 | A1 | 9/1988 |

* cited by examiner

*Primary Examiner* — Saul Rodriguez
*Assistant Examiner* — Jaimin G Patel
(74) *Attorney, Agent, or Firm* — Smartpat PLC

(57) ABSTRACT

A workpiece manipulator (1) for use with a radial forging press includes workpiece tongs (4). The workpiece tongs (4) are fastened to a manipulator frame (2) guided linearly on a manipulator track. The workpiece tongs (4) form a chuck with a fixed clamping axis (5) which extends in the forging axis or parallel to the forging axis. The workpiece can be manipulated with a linear translational movement. The manipulator frame (2) is rail-bound on wheels (12) during the translational movement.

9 Claims, 2 Drawing Sheets

WORKPIECE MANIPULATOR

CROSS-REFERENCE TO RELATED APPLICATION

This application claims the benefit of German Patent Application DE 102022208238.9, filed on Aug. 8, 2022, the contents of which is hereby incorporated by reference.

BACKGROUND

A workpiece manipulator or forging manipulator is known, for example, from DE 10 2012 217 650 A1. The publication describes a forging manipulator with a tongs carrier for arranging workpiece tongs, the tongs carrier being arranged in a translationally movable manipulator frame and being variably positionable relative to the manipulator frame for handling a workpiece held in the workpiece tongs. The tongs carrier is connected on a translation axis via a spring device with the manipulator frame, wherein the spring device is provided with a switching device for the defined release of the energy stored in the spring device.

Forging manipulators of the type mentioned in this publication are used in so-called open die forging, in which the workpiece to be machined in a forging device designed as a forging press is held in a tongs carrier of the forging manipulator and, by means of a lifting, tilting or rotating movement of the tongs arranged in a manipulator frame of the forging manipulator, is moved into a desired relative position to the forging press, in order to be deformed in a defined manner by means of a press part of the forging device.

In open die forging, it is necessary to actively hydraulically carry the workpiece along with half the press stroke, with damping of impacts and shocks from the forging process being compensated for by the hydraulics of the manipulator.

In the case of radial forging presses, it is customary to linearly guide the forging manipulator in a manipulator track. In a radial forging press, the billet to be forged is formed by several, usually four, forging tools that forge the circumference of the billet simultaneously and synchronously, while the forging manipulator holds the rear end of the billet or ingot. This results in the need for the forging manipulator to grip and hold the workpiece in the forging axis, with manipulation of the forging workpiece naturally only being possible in the translation axis of the forging manipulator.

For example, a loading system and a loading method for radial forging presses are known from DE 10 2014 226 384 A1. The loading system includes a linear guide system for the forging manipulator, which is integrated into a manipulator track below a floor level of the forging manipulator.

In principle, it is known to carry out the horizontal guidance of the forging manipulator as a sliding guide. Such a sliding guide has the disadvantage that an oil film has to be permanently applied to the entire length of the guide to reduce friction and wear. The required amount of oil does not only result from the amount required for lubrication alone, but also for rinsing off contamination in the form of scale from the guideway. This requires a large amount of oil that has to be constantly applied, checked and drained off as well as processed. This also requires a correspondingly complex foundation and/or a basement below floor level, in which the units required for lubrication can be accommodated.

Loss lubrication of the type described above has the disadvantage of high investment and maintenance costs.

SUMMARY

The disclosure relates to a workpiece manipulator for use with a radial forging press. The workpiece manipulator includes workpiece tongs. The workpiece tongs are fastened to a manipulator frame guided linearly on a manipulator track. The workpiece tongs form a chuck with a fixed clamping axis that extends in the forging axis or parallel to the forging axis. The workpiece can be manipulated with a linear translational movement of the manipulator frame.

The disclosure provides a workpiece manipulator or forging manipulator for use with a radial forging press which requires less maintenance then known manipulators. The disclosed workpiece manipulator for use with a radial forging press is also suitable for absorbing forces resulting from the forging process.

According to one aspect of the invention, a workpiece manipulator is provided for use with a radial forging press. The workpiece tongs are attached to a manipulator frame linearly guided on a manipulator track. The workpiece tongs form a chuck with a fixed clamping axis which extends in the forging axis or parallel to the forging axis. The workpiece can so be manipulated with a linear translational movement.

The manipulator frame is expediently guided on rail-bound wheels during the translational movement.

The workpiece manipulator is expediently designed in such a way that only a single linear manipulation movement is possible, preferably in the forging axis or in the translation axis of the manipulator frame. The workpiece manipulator also expediently has a degree of rotational freedom, so that the workpiece, which is held by the workpiece tongs, can be rotated by an angle during successive tool movements.

The manipulator frame is expediently guided linearly, with the workpiece manipulator preferably being guided for this purpose by means of at least two guide rails or guideways laid within a floor level.

In an expedient preferred variant of the workpiece manipulator, it is provided that the manipulator frame includes a chassis which is spring-loaded and/or damped. This design has the advantage that the vertical forces resulting from the forging process in the form of shocks or impacts are intercepted or cushioned and/or dampened, which reduces the forces acting on individual wheels or also rollers of the chassis.

The chassis can include a plurality of wheel groups. The wheel groups can each comprise a wheel carrier with a plurality of running wheels.

The wheel groups or the wheel carriers can each be mounted in a swinging/seesaw manner in order to increase the bearing portion of the individual wheels. For this purpose, it can be provided, for example, that the wheel carriers are each articulated pivotably on the manipulator frame.

For example, a total of four wheel groups can be provided on the manipulator frame, wherein it is possible for the manipulator frame to have two front and two rear wheel groups. The front wheel groups are expediently arranged at the same height on a side of the manipulator frame facing a tongs carrier. The rear wheel groups can be arranged on the side of the manipulator frame facing away from the tongs carrier.

In a particularly expedient and advantageous embodiment of the workpiece manipulator, it is provided that at least two wheel groups are each provided with spring and/or damper elements. In a special embodiment, the two front wheel groups, i.e., the wheel groups arranged closest to the workpiece tongs, are provided with spring and/or damper elements. The spring and/or damper elements can be designed as simple spring dampers or as spring elements with an additional hydraulic damping system.

Each wheel carrier is preferably supported on the manipulator frame with a plurality of spring and/or damper elements. A spring and/or damper element can be provided for each individual wheel arranged on the wheel carrier, so that the number of spring and/or damper elements corresponds to the number of wheels. The springs are preferably prestressed in such a way that the manipulator's own weight is carried. When the manipulator is placed on the track, the springs are thus relieved.

In an expedient variant of the workpiece manipulator, each wheel carrier can include four wheels and four spring and/or damper elements.

At least first wheel groups at the front in the direction of the translation movement and second rear wheel groups are expediently provided on the manipulator frame, with the first wheel groups being arranged at a first small distance from the workpiece tongs or from a tongs carrier and the second running wheel groups being arranged at a second larger distance from the workpiece tongs or the tongs carrier.

As already mentioned above, the wheels interact with one or more guideways or one or more guide rails, which extend within the floor level of the radial forging press. Advantageously, brushes are provided in front of and/or behind at least one wheel carrier, preferably in front of and/or behind all wheel carriers, which brush off any scale that may be present on the guideway during the translational movement of the workpiece manipulator.

The workpiece tongs expediently comprise a plurality of tong jaws arranged at equal distances on a radius around the fixed clamping axis. Preferably, the workpiece tongs comprise four tong jaws distributed at equal intervals of 90° over the radius.

The disclosure also relates to a system for manipulating a forged workpiece at a radial forging press, comprising a workpiece manipulator with workpiece tongs, which are preferably attached to a tongs carrier, the workpiece tongs being attached to a manipulator frame guided linearly on a manipulator track, and the workpiece tongs forming a chuck with a fixed clamping axis, which extends in the forging axis or parallel to the forging axis, so that the tool can be manipulated with a linear translational movement, the manipulator frame being guided on rail-bound wheels during the translational movement. The system also includes a manipulator track with at least two guide rails laid within a floor level, which form a guideway for the workpiece manipulator.

The invention is explained below with reference to an embodiment shown in the drawings.

DETAILED DESCRIPTION

Figure 1:
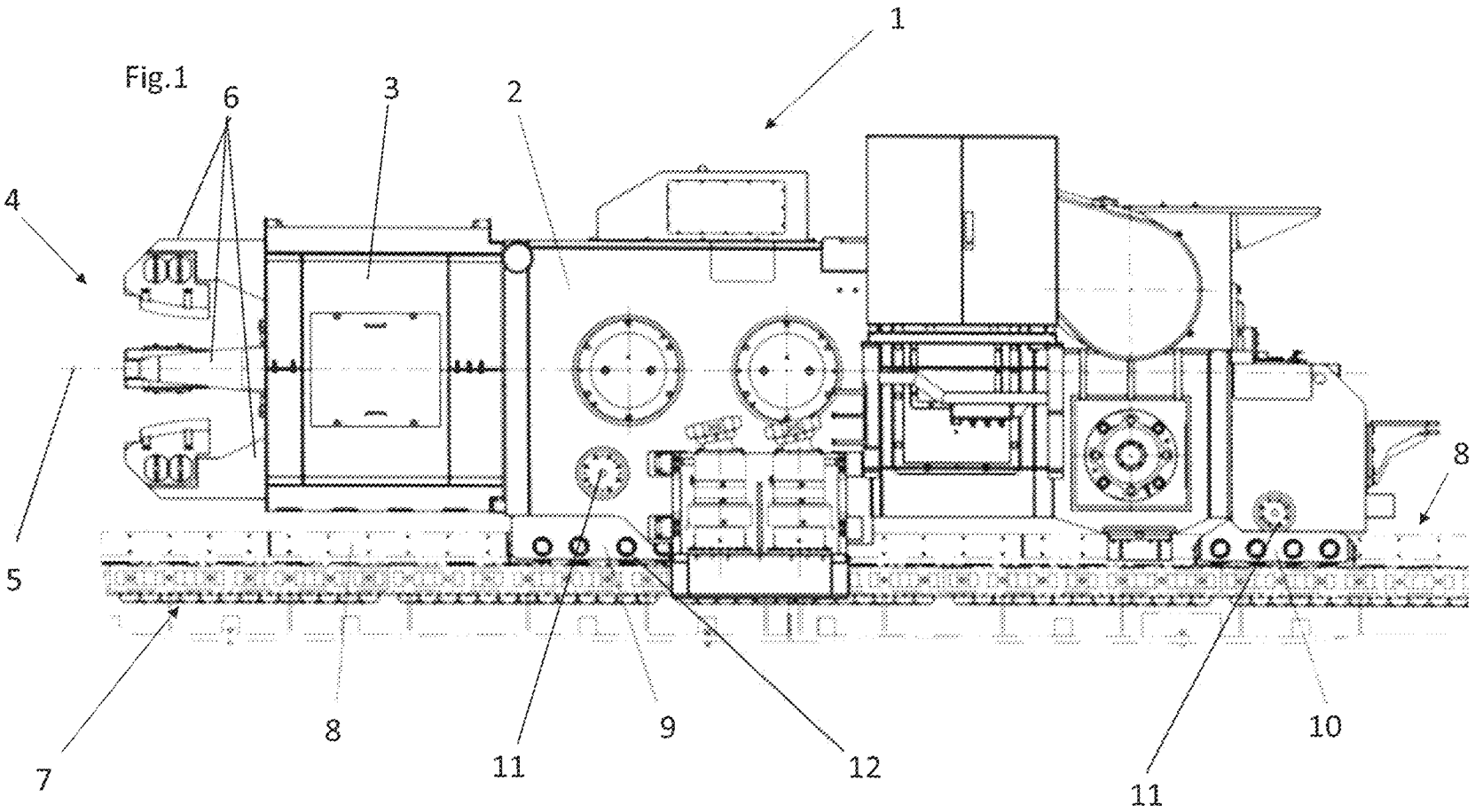
FIG. 1 is a schematic representation of the workpiece manipulator.

The workpiece manipulator 1, which is designed as a forging manipulator for a radial forging press, comprises a manipulator frame 2 with a tongs carrier 3 with workpiece tongs 4 attached to it. The workpiece tongs 4 comprise four tong jaws 6 arranged at equal distances from one another on a radius around a fixed clamping axis 5. When actuated, the jaws 6 perform a synchronous opening and closing movement in the same direction with respect to the clamping axis 5.

The workpiece manipulator 1 can be moved linearly on a floor level 7 in front of a radial forging press, not shown, with the clamping axis 5 of the workpiece manipulator 1 extending within the forging axis of the radial forging press. The workpiece, not shown, in the form of a billet to be forged or an ingot is held at the end by the workpiece tongs 4 and fed to the radial forging press via a linear displacement movement of the workpiece manipulator 1.

Figure 2:
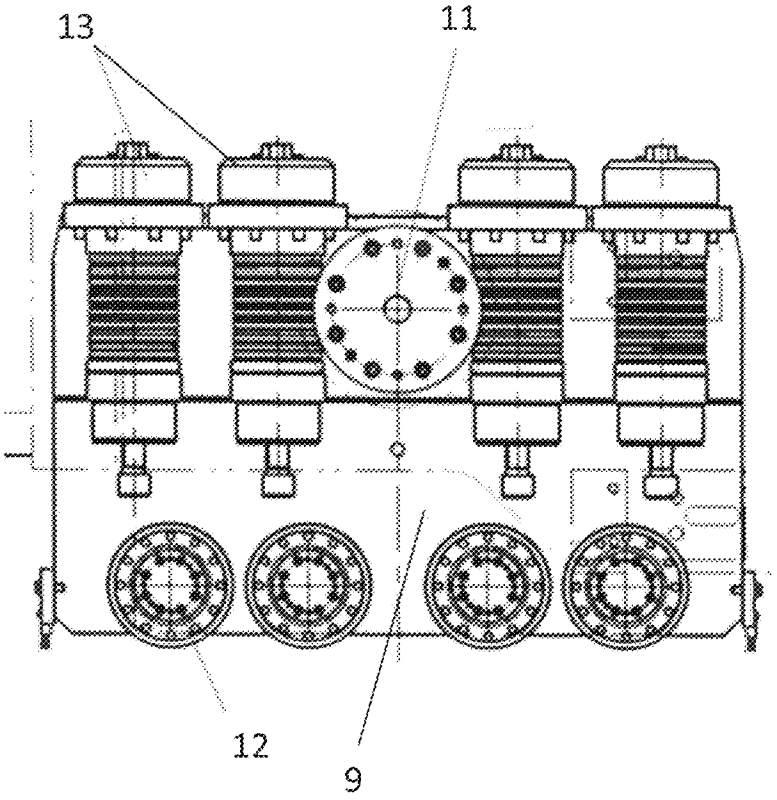
FIG. 2 shows a detailed view of parts of the chassis of the workpiece manipulator from FIG. 1.

The workpiece gripped with the workpiece tongs 4 or the forging billet, which was previously lifted out of a furnace at forging heat to the height of the forging axis and then clamped by the workpiece tongs 4 in the forging axis or in the clamping axis 5, can be moved via a linear movement of the manipulator frame 2 on a guideway 8 during the forging process only linearly according to the translational movement of the manipulator frame 2. In addition, the workpiece tongs 4 can be rotated about the clamping axis 5. The manipulator frame 2 includes a chassis that includes two first front wheel carriers 9 and two second rear wheel carriers 10. The wheel carriers 9, 10 are articulated on the manipulator frame 2 such that they can pivot about a pivot axis 11 of the latter and each comprise four running wheels 12 (see detailed view according to FIG. 2).

The running wheels 12 are each supported on a guideway 8 designed as a guide rail. The first front wheel carriers 9 are also supported against the manipulator frame 2 via spring/damping elements 13. The second rear wheel carriers 10, on the other hand, are articulated on the manipulator frame 2 in an unsprung manner.

REFERENCE SIGN LIST

1 workpiece manipulator
2 manipulator frame
3 tongs carrier
4 workpiece tongs
5 clamping axis
6 tongs jaw
7 floor level
8 guideway
9 first wheel carrier
10 second wheel carrier
11 pivot axes
12 wheels
13 spring/damping element

What is claimed is:

1. A workpiece manipulator (1) for use with a radial forging press, comprising:

workpiece tongs (4) configured to hold a workpiece during radial forging, the workpiece tongs (4) being attached to a manipulator frame (2) guided linearly on a manipulator track, and the workpiece tongs (4) forming a chuck with a fixed clamping axis (5) that extends in a forging axis, so that the workpiece can be manipulated with a linear translational movement, wherein the manipulator frame (2) is guided rail-bound on wheels (12) during the linear translational movement, wherein the manipulator frame (2) comprises a chassis having wheel carriers (9,10), including two front wheel carriers (9) proximal to the workpiece tongs (4) and two rear wheel carriers (10) distal from the workpiece tongs (4), and wherein the wheel carriers (9,10) are each articulated pivotably on the manipulator frame (2).

2. The workpiece manipulator (1) according to claim 1, wherein each wheel carrier (9,10) includes a plurality of the wheels (12).

3. The workpiece manipulator (1) according to claim 1, wherein the two front wheel carriers (9) are each provided with spring and/or damper elements (13).

4. The workpiece manipulator (1) according to claim 2, wherein each running wheel carrier (9,10) is supported with a plurality of spring and/or damper elements (13) on the manipulator frame (2).

5. The workpiece manipulator (1) according to claim 1, wherein the workpiece tongs (4) comprise a plurality of tongs jaws (6) arranged at equal distances on a radius around the fixed clamping axis (5).

6. A system comprising:

the workpiece manipulator (1) according to claim 1; and the manipulator track, having at least two guide rails laid in a floor level (7).

7. The workpiece manipulator (1) according to claim 1, wherein the two front wheel carriers (9) are supported on the manipulator frame (2) by spring and/or damper elements (13), and wherein the two rear wheel carriers (10) are articulated on the manipulator frame (2) without spring or damper elements.

8. The workpiece manipulator (1) according to claim 7, wherein each of the two front wheel carriers (9) includes four of the wheels (12) and four of the spring and/or damper elements (13).

9. The workpiece manipulator (1) according to claim 8, wherein each of the two front wheel carriers (9) is articulated on the manipulator frame (2) so as to pivot about a pivot axis (11), and wherein the pivot axis (11) extends between two of the four spring and/or damper elements (13).

* * * * *